US010772414B1

(12) United States Patent
Meram

(10) Patent No.: US 10,772,414 B1
(45) Date of Patent: Sep. 15, 2020

(54) FLAG FOOTBALL BELT

(71) Applicant: Francis Meram, Bloomfield Hills, MI (US)

(72) Inventor: Francis Meram, Bloomfield Hills, MI (US)

( * ) Notice: Subject to any disclaimer, the term of this patent is extended or adjusted under 35 U.S.C. 154(b) by 1 day.

(21) Appl. No.: 16/356,228

(22) Filed: Mar. 18, 2019

(51) Int. Cl.
*A45F 5/02* (2006.01)
*A63B 67/00* (2006.01)
*A63B 71/06* (2006.01)

(52) U.S. Cl.
CPC ..... *A45F 5/021* (2013.01); *A63B 67/00* (2013.01); *A63B 71/06* (2013.01); *A44D 2203/00* (2013.01); *A63B 2243/007* (2013.01)

(58) Field of Classification Search
CPC .. Y10T 24/4016; Y10T 24/4072; A63B 67/00
USPC ..... 473/502; 24/170, 191–193
See application file for complete search history.

(56) References Cited

U.S. PATENT DOCUMENTS 3,328,856 A * 7/1967 Jonas ..... A44B 11/14 24/191
3,579,745 A * 5/1971 Wilson ..... A45F 5/02 24/307
3,608,158 A * 9/1971 Bengtsson ..... A44B 11/12 24/170
3,678,542 A 7/1972 Prete, Jr.
3,852,855 A * 12/1974 Bengtsson ..... B65D 63/16 24/265 EE
4,304,403 A * 12/1981 Wilson ..... A63B 67/00 24/310
4,651,989 A * 3/1987 Wilson ..... A41F 9/002 2/321
4,726,625 A * 2/1988 Bougher ..... A44B 11/12 24/170
4,843,688 A * 7/1989 Ikeda ..... A44B 11/12 24/170
5,269,050 A * 12/1993 Yewer, Jr. ..... A44B 11/12 128/876
5,371,926 A * 12/1994 Van Noy ..... A43C 11/00 24/171
5,456,462 A 10/1995 Wilson
5,661,877 A * 9/1997 Bloomer ..... A44B 11/12 24/170
6,241,631 B1 * 6/2001 Wilson ..... A44B 11/04 473/502

(Continued)

*Primary Examiner* — Jeffrey S Vanderveen
(74) *Attorney, Agent, or Firm* — Carlson, Gaskey & Olds, P.C.

(57) ABSTRACT

A belt attachment assembly, belt buckle, and flag football belt are each disclosed. The belt attachment assembly includes a belt attachment member having a first connector, and a flag attachment assembly having a second connector. One of the first and second connectors includes a protrusion, and the other of the first and second connectors includes a receptacle sized to receive the protrusion. When the protrusion is received into the receptacle, a magnetic force retains the protrusion in the receptacle. The belt buckle includes opposing first and second sidewalls, a support member extending between and fixed relative to the sidewalls, and a tongue that pivots with respect to the sidewalls between an open position and a closed position. The belt buckle provides a belt path that in the closed position extends from a belt-accepting end of the belt to a first portion and then to a second portion.

8 Claims, 7 Drawing Sheets

(56) References Cited

U.S. PATENT DOCUMENTS

| | | | | |
|---|---|---|---|---|
| 6,308,381 | B1 | 10/2001 | Wilson | |
| 10,258,855 | B1 * | 4/2019 | DiMartino | A63B 71/06 |
| 2003/0172499 | A1 * | 9/2003 | Uehara | A44B 11/12<br>24/170 |
| 2007/0240286 | A1 * | 10/2007 | Kawaguchi | A44B 11/12<br>24/191 |
| 2008/0139345 | A1 | 6/2008 | Baun et al. | |
| 2009/0042675 | A1 * | 2/2009 | Baun, II | A63B 67/00<br>473/502 |
| 2009/0045675 | A1 | 2/2009 | Baun, II et al. | |
| 2018/0289138 | A1 | 10/2018 | Lewis | |

* cited by examiner

FLAG FOOTBALL BELT

BACKGROUND

This application relates to flag football, and more particularly to a flag football belt and its components.

Flag football is a version of American football in which players wear a belt with detachable flag straps, and instead of tackling a player to establish a "down," a defensive player instead attempts to remove a flag of the player from that player's belt. Flag football is popular for both younger players and adults, as safety gear needed for tackle football can be avoided, making the game generally safer to play.

Traditionally, flags have been secured to a flag football belt using either a hook and loop fastener (e.g., VELCRO), or a cylindrical member that is received into a receptacle and remains attached due to friction and/or suction. Over time, flag football belts using such attachment mechanisms deteriorate so that flags detach too easily, potentially by accident with no interaction from a defensive player.

SUMMARY

A belt attachment assembly according to an example of the present disclosure includes a belt attachment member and a flag attachment member. The belt attachment member includes opposing first and second ends connected by a stem, a belt aperture at the first end, a first connector at the second end, and a first magnet. The flag attachment member includes a flag aperture at a first end, a second connector at a second end, and a second magnet. One of the first and second connectors includes a protrusion, and the other of the first and second connectors includes a receptacle sized to receive the protrusion. When the protrusion is received into the receptacle, one of the first and second magnets provides a magnetic force to the other of the first and second magnets that retains the protrusion in the receptacle.

In a further embodiment of any of the foregoing embodiments, the receptacle and protrusion are each cylindrical.

In a further embodiment of any of the foregoing embodiments, the one of the first and second connectors that includes the receptacle includes at least one longitudinal sidewall that surrounds a bottom wall and at least partially defines the receptacle, and includes its corresponding one of the first and second magnets within the bottom wall.

In a further embodiment of any of the foregoing embodiments, the one of the first and second connectors that includes the protrusion includes its corresponding one of the first and second magnets within a distal end of the protrusion.

In a further embodiment of any of the foregoing embodiments, the first connector includes the receptacle, and the second connector includes the protrusion.

In a further embodiment of any of the foregoing embodiments, the belt aperture extends along a first axis that intersects a central longitudinal axis of the first connector at an oblique angle.

In a further embodiment of any of the foregoing embodiments, a centerline of the stem is coaxial with the central longitudinal axis.

In a further embodiment of any of the foregoing embodiments, at the first end of the belt attachment member, a rectangular loop defines the belt aperture, and the stem connects to a corner of the rectangular loop.

A belt buckle according to an example of the present disclosure includes, opposing first and second sidewalls that are fixed relative to each other and extend between a belt-attaching end and a belt-accepting end. A support member extends between and is fixed relative to the first and second sidewalls. A tongue pivots with respect to the first and second sidewalls between an open position and a closed position. The tongue includes a lever portion and a tab that extends outwards from the lever portion. The belt buckle provides a belt path that in the closed position extends from the belt-accepting end to a first portion and then to a second portion. The first portion is provided between the lever portion and a first surface of the support member, and the second portion is provided between the tab and a second surface of the support member that is angled with respect to the first surface.

In a further embodiment of any of the foregoing embodiments, a first projection extends outwards from the second surface, and a second projection extends outwards from the tab. In the open position, the second projection is on a first side of the first projection, and in the closed position, the second projection is on a second side of the first projection that is opposite the first side.

In a further embodiment of any of the foregoing embodiments, in the closed position, the first projection extends outwards from the second surface towards the tab, the second projection extends outwards from the tab towards the second surface, and the belt path is sinuous and includes a first turn at the first projection and a second turn at the second projection.

In a further embodiment of any of the foregoing embodiments, the second projection extends outwards from the tab in a direction approximately parallel to the lever portion.

In a further embodiment of any of the foregoing embodiments, in the open position, the second projection is outside a boundary of the sidewalls, and in the closed position, the second projection is within the boundary of the sidewalls.

In a further embodiment of any of the foregoing embodiments, a pivot opening is provided in the tongue or opposing sidewalls, and a pivot member extends into each pivot opening at a location between the belt-attaching end and the belt-accepting end. The tongue pivots about a longitudinal axis of the pivot member, and in the closed position the second projection extends outwards from the tab in a direction away from each pivot opening.

In a further embodiment of any of the foregoing embodiments, a belt-guiding member extends between the first and second sidewalls at a location between the pivot member and the belt-attaching end. The belt-guiding member is sloped upwards from an inner side of the belt buckle towards an outer side of the belt buckle. A third portion of the belt path is provided between the belt-guiding member and the pivot member.

A flag football belt according to an example of the present disclosure incudes a belt strap, a flag strap, and a magnetic clasp assembly that removably secures the flag strap to the belt strap. The magnetic clasp assembly includes a belt attachment member including first and second ends connected by a stem, a belt aperture at the first end that receives the belt strap, a first connector at the second end, and a first magnet. The magnetic clasp assembly also includes a flag attachment member including a flag aperture at a first end that receives the flag strap, a second connector at the second end, and a second magnet. One of the first and second connectors includes a protrusion, and the other of the first and second connectors includes a receptacle sized to receive the protrusion. When the protrusion is received into the receptacle, one of the first and second magnets provides a magnetic force to the other of the first and second magnets that retains the protrusion in the receptacle. A belt buckle includes opposing first and second sidewalls that are fixed relative to each other and extend between opposing first and second ends, the first end attached to a first end of the belt strap, and the second end configured to removably accept a second end of the belt strap. A support member extends between and fixed relative to the first and second sidewalls, and a tongue that pivots with respect to the first and second sidewalls between an open position and a closed position, the tongue including a lever portion and a tab that extends outwards from the lever portion. The belt buckle provides a belt path that in the closed position extends from the second end to a first portion and then to a second portion, the first portion provided between the lever portion and a first surface of the support member, and the second portion provided between the tab and a second surface of the support member that is angled with respect to the first surface.

In a further embodiment of any of the foregoing embodiments, a first projection extends outwards from the second surface, and a second projection extends outwards from the tab. In the open position, the second projection is on a first side of the first projection, and in the closed position, the second projection is on a second side of the first projection that is opposite the first side.

In a further embodiment of any of the foregoing embodiments, in the closed position, the first projection extends outwards from the second surface towards the tab, the second projection extends outwards from the tab towards the second surface, and the belt path is sinuous and includes a first turn at the first projection and a second turn at the second projection.

In a further embodiment of any of the foregoing embodiments, in the open position the second projection is outside a boundary of the sidewalls, and in the closed position the second projection is within the boundary of the sidewalls.

In a further embodiment of any of the foregoing embodiments, a pivot opening is provided in the tongue or the opposing sidewalls, and a pivot member extends into each pivot opening at a location between the belt-attaching end and the belt-accepting end. The tongue pivots about a longitudinal axis of the pivot member, and in the closed position the second projection extends outwards from the tab in a direction away from the pivot opening. The belt buckle includes a belt-guiding member that extends between the first and second sidewalls at a location between the pivot member and the belt-attaching end, The belt-guiding member is sloped upwards from an inner side of the belt buckle towards an outer side of the belt buckle, and a third portion of the belt path is provided between the belt-guiding member and the pivot member.

The embodiments, examples, and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
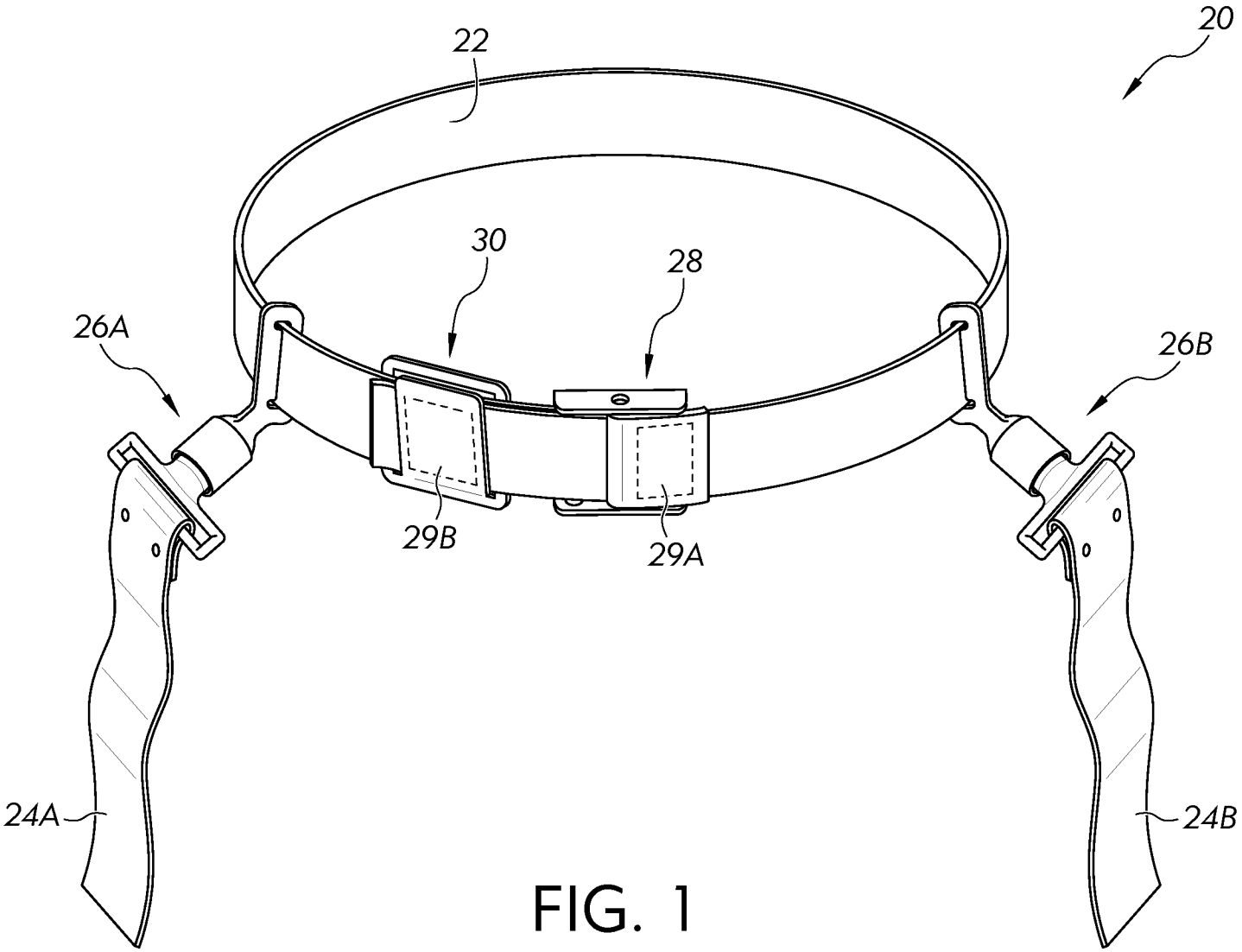
FIG. 1 illustrates an example flag football belt that includes a plurality of removable flag straps.

FIG. 1 illustrates an example flag football belt 20 that includes a belt strap 22 and a plurality of flag straps 24A-B that are removably attached to the belt strap 22. A first magnetic clasp assembly 26A is provided for removably attaching the first flag strap 24A to the belt strap 22, and a second magnetic clasp assembly 26B is provided for removably attaching the flag strap 24B to the belt strap 22. Although only two flags are shown, it is understood that other quantities of flags could be used, such as one, three, or four flags.

A buckle 28 provides for opening, closing, and resizing the belt 20. A belt clip 30 is provided for securing a free end of the belt strap 22 to a portion of the belt strap 22 between the buckle 28 and first magnetic clasp assembly 26A. Optionally, logos 29A-B can be provided on the buckle 28 and/or belt clip 30.

Figure 2A:
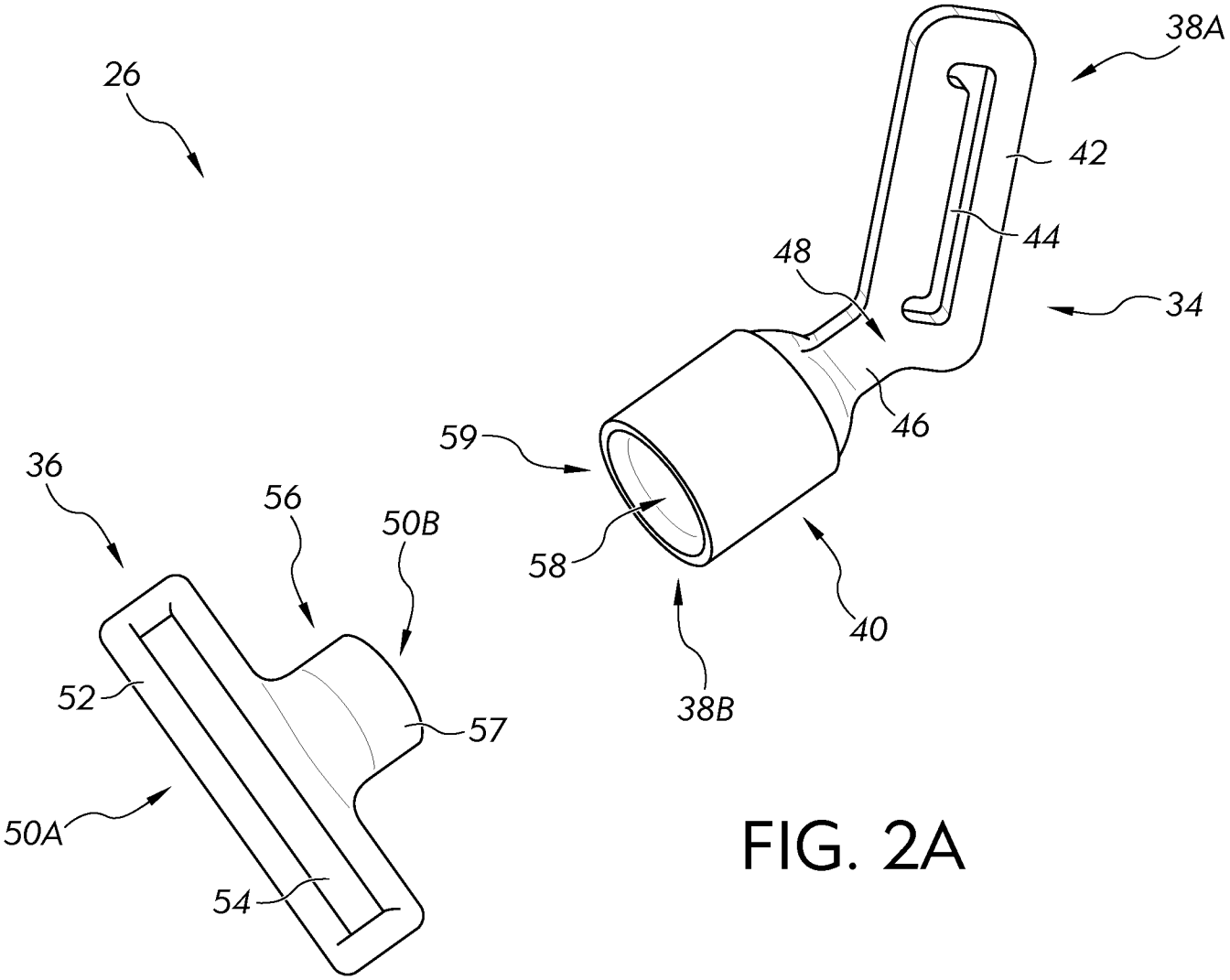
FIG. 2A illustrates a flag assembly from the belt of FIG. 1 in a detached state.

FIG. 2A illustrates one of the magnetic clasp assemblies 26 in a detached state. The magnetic clasp assembly 26 includes a belt attachment member 34 and a flag attachment member 36. The belt attachment member 34 includes opposing first and second ends 38A-B. A first connector 40 is provided at the second end 38B. A rectangular loop 42 is provided at the first end 38A, and the rectangular loop 42 defines a belt aperture 44 for receiving the belt strap 22. A stem 46 connects the rectangular loop 42 to the first connector 40. In the example of FIG. 2A, the stem attaches at a corner 48 of the rectangular loop 42. Of course, other attachment locations could be used.

The flag attachment member 36 includes opposing first and second ends 50A-B. A rectangular loop 52 is provided at the first end 50A, and the rectangular loop 52 defines a flag aperture 54 for receiving one of the flag straps 24. A second connector 56 is provided at the second end 50B of the flag attachment member 36.

In the example of FIG. 2A the second connector 56 is a protrusion 57, and the first connector 40 includes a receptacle 58 sized to receive the protrusion 57. The first connector 40 includes an opening 59 for receiving the protrusion 57 into the receptacle 58.

In the example of FIG. 2A the protrusion 57 and receptacle 58 are each cylindrical. This is a non-limiting example, and other cross-sectional shapes could be used, such as triangular, rectangular, hexagonal, etc.

In another example, not shown, the magnetic clasp assembly 26 is arranged so that the connector 40 provides as protrusion instead of a receptacle, and the connector 56 provides a receptacle instead of a protrusion, such that the first connector 40 is received into the second connector 56.

Figure 2B:
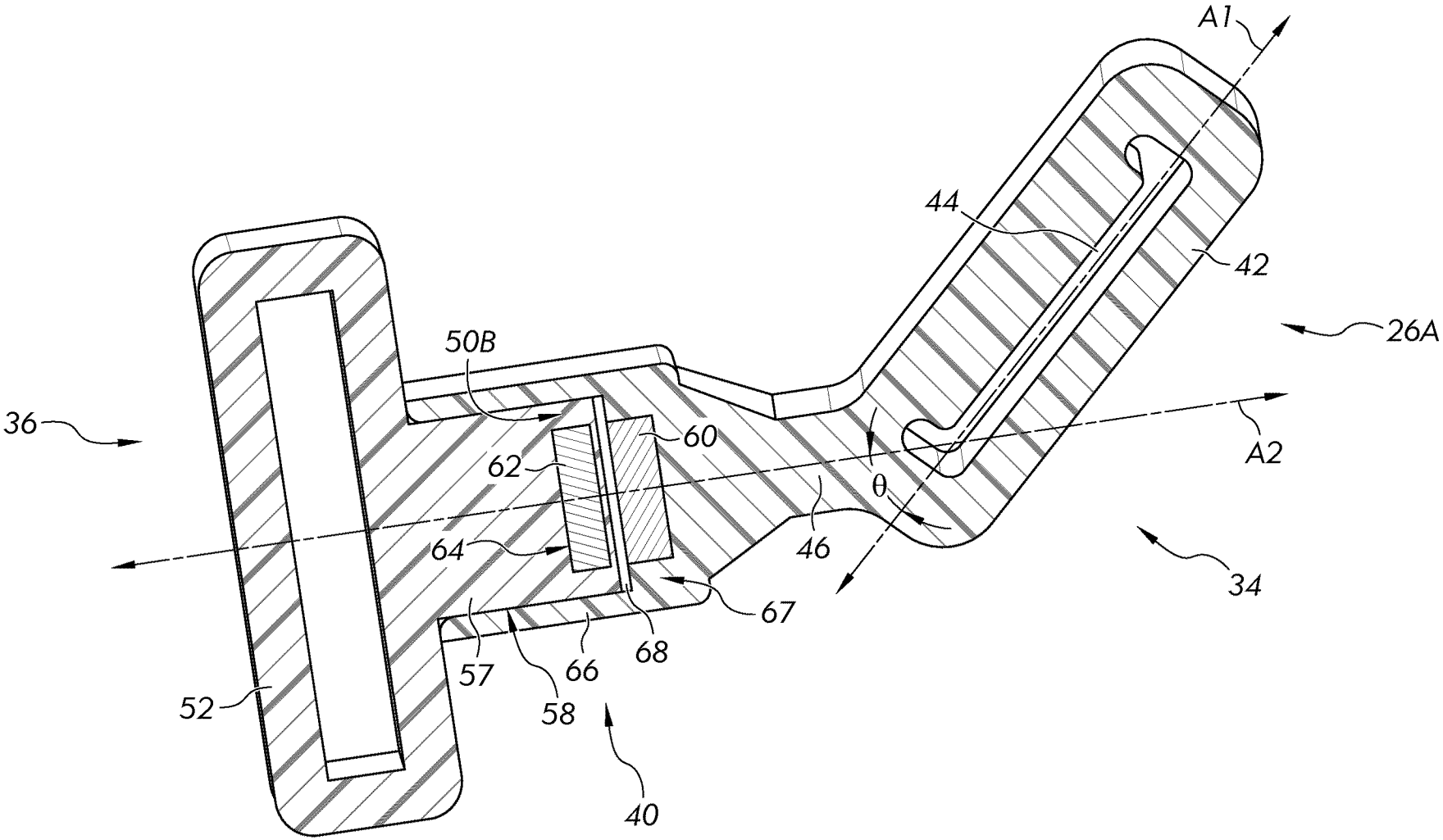
FIG. 2B illustrates a cross-sectional view of the flag assembly of FIG. 1 in a connected state.

FIG. 2B illustrates a cross-sectional view of the magnetic clasp assembly 26 in a connected state, in which the connector 57 is received into the receptacle 58. As shown in FIG. 2B, the belt attachment member 34 includes a first magnet 60, and the flag attachment member 36 includes a second magnet 62. When the protrusion 57 is received into the receptacle 58, at least one of the first magnet 60 and second magnet 62 provides a magnetic force to the other of the first magnet 60 and second magnet 62 that retains the protrusion 57 in the receptacle 58.

In one example, the first magnet 60 is a permanent magnet and the second magnet 62 is made of a ferromagnetic material that is attracted to the permanent magnet 60. In another example, the second magnet 62 is a permanent magnet and the first magnet 60 is made of a ferromagnetic material that is attracted to the permanent magnet 62. In a third example, each of the magnets 60 and 62 are permanent magnets.

The magnetic force mitigates accidental flag drops by retaining the protrusion 57 in the receptacle 58. Although the magnetic clasp assembly 26 may be configured such that the protrusion 57 fits snugly into the receptacle 58, loosening of that snug fit over time will not diminish the magnetic force, so that the flag football belt 20 will have a longer usable life than prior art belts which relied on such a snug fit for attachment.

In the example of FIG. 2B, the second magnet 62 is provided within a recess 64 in a distal end of the protrusion 57 at end 50B of the flag attachment member 36, and the first magnet 60 is provided within a bottom wall 67 of the first connector. The bottom wall 67 is surrounded by a longitudinal sidewall 66 that defines the opening 59. A plate 68 is provided on the bottom wall 67 and retains the first magnet 60 in the bottom wall 67.

The belt aperture 44 extends along a first axis A1. The protrusion 57 and receptacle 58 and stem 46 share a common central longitudinal axis A2, which extends along a centerline of the protrusion 57, receptacle 58, and stem 46. The axis A1 intersects the axis A2 at an oblique angle θ, such that the axes A1 and A2 intersect but are non-parallel and non-perpendicular. This angle feature extends the flag straps 24 away from a wearer's body, making it easier to grab the flag straps 24 without grabbing the pants or shorts of the wearer.

Figure 3A:
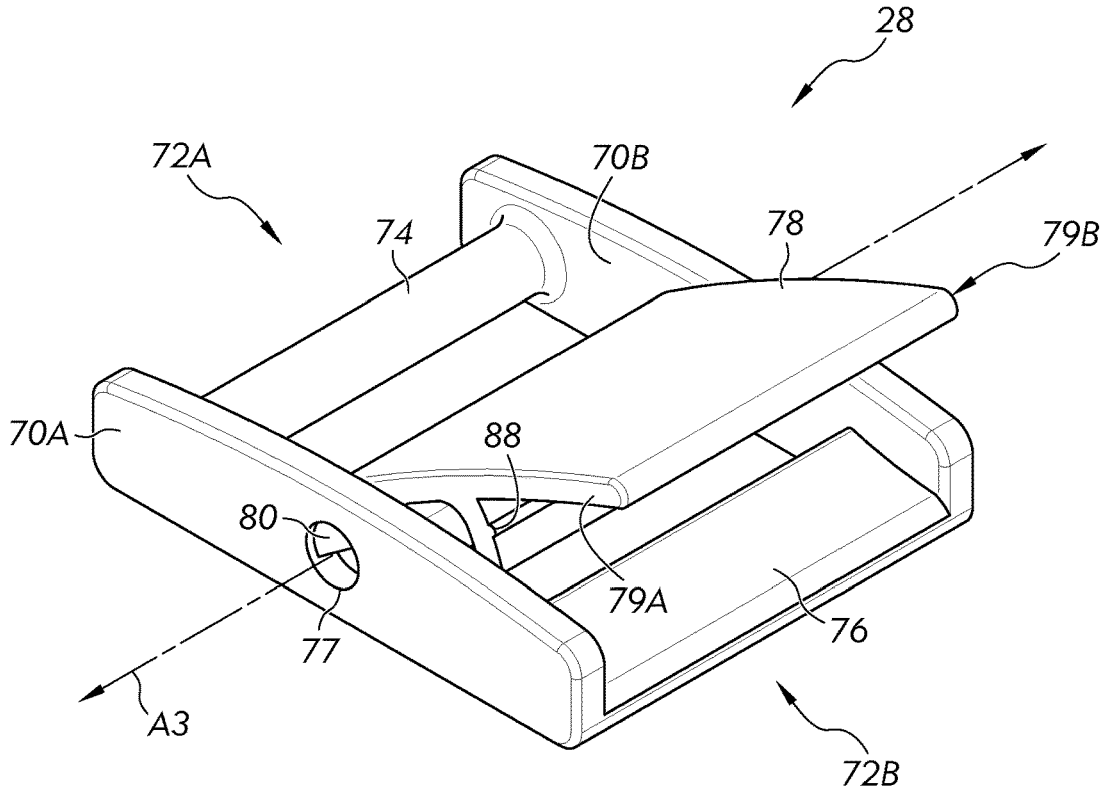
FIG. 3A illustrates a perspective view of a belt buckle of FIG. 1 in an open position.
Figure 3B:
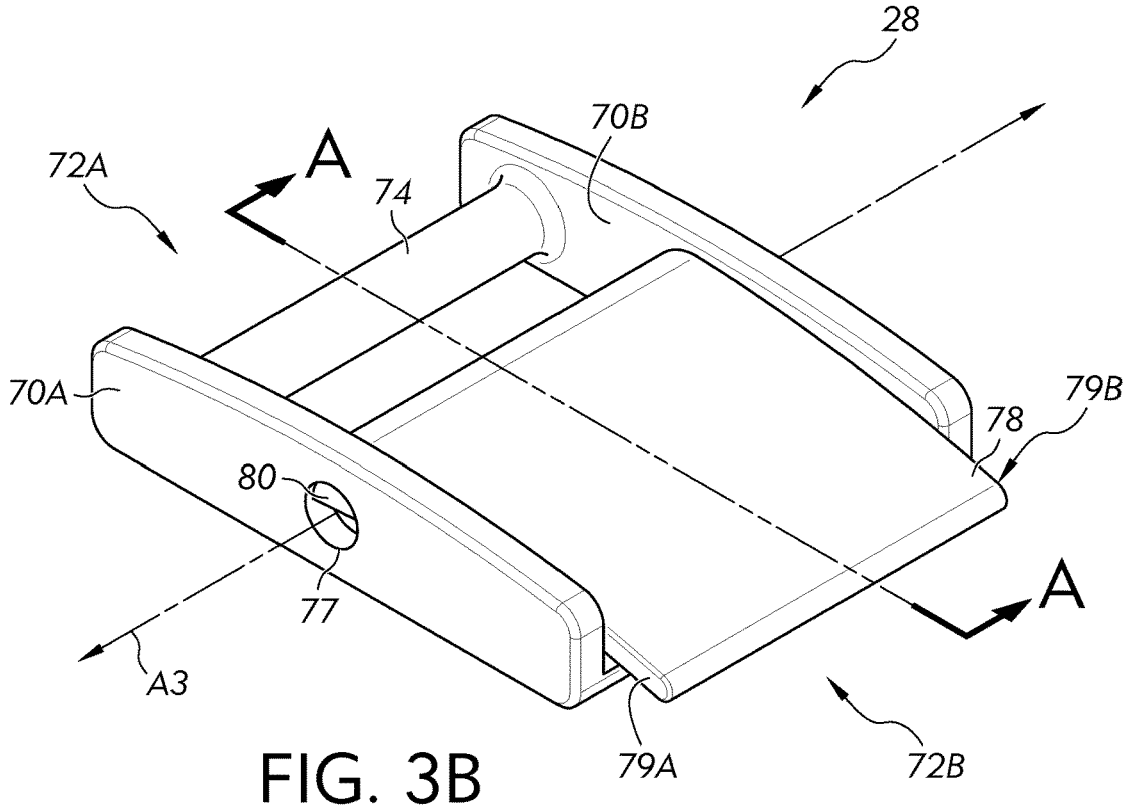
FIG. 3B illustrates a perspective view of the belt buckle of FIG. 1 in a closed position.

FIG. 3A illustrates a perspective view of the buckle 28 of FIG. 1 with its tongue 78 in an open position, and FIG. 3B illustrates a perspective of the buckle 28 with its tongue 78 in a closed position. The buckle 28 includes opposing first and second sidewalls 70A-B that are fixed relative to each other and extend between a belt-attaching end 72A and belt-accepting end 72B of the buckle 28.

A first support member 74 extends between the opposing sidewalls 70A-B proximate to the belt-attaching end 72A, and a second support member 76 extends between the opposing sidewalls 70A-B proximate to the belt-accepting end 72B. Support members 74 and 76 are fixed relative to each other and the opposing sidewalls 70A-B.

The tongue 78 is provided between the opposing sidewalls 70A-B. The tongue 78 pivots about a pivot axis A3 between an open position shown in FIG. 3A and a closed position shown in FIG. 3B. The tongue 78 includes opposing first and second edges 79A-B.

Each sidewall 70A-B includes a respective pivot opening 77 centered on the pivot axis A3 (one of which is shown in FIGS. 3A-B), and the tongue 78 includes a respective pivot member 80 extending outwards from each of its edges 79A-B (one of which is shown in FIGS. 3A-B) that extends into a respective one of the pivot openings 77. This enables the tongue 78 to pivot about the pivot axis A3.

In an alternative embodiment, the pivot opening is provided through the tongue 78, and the pivot members 80 extend into the pivot opening from the sidewalls 70A-B of the buckle.

Figure 4A:
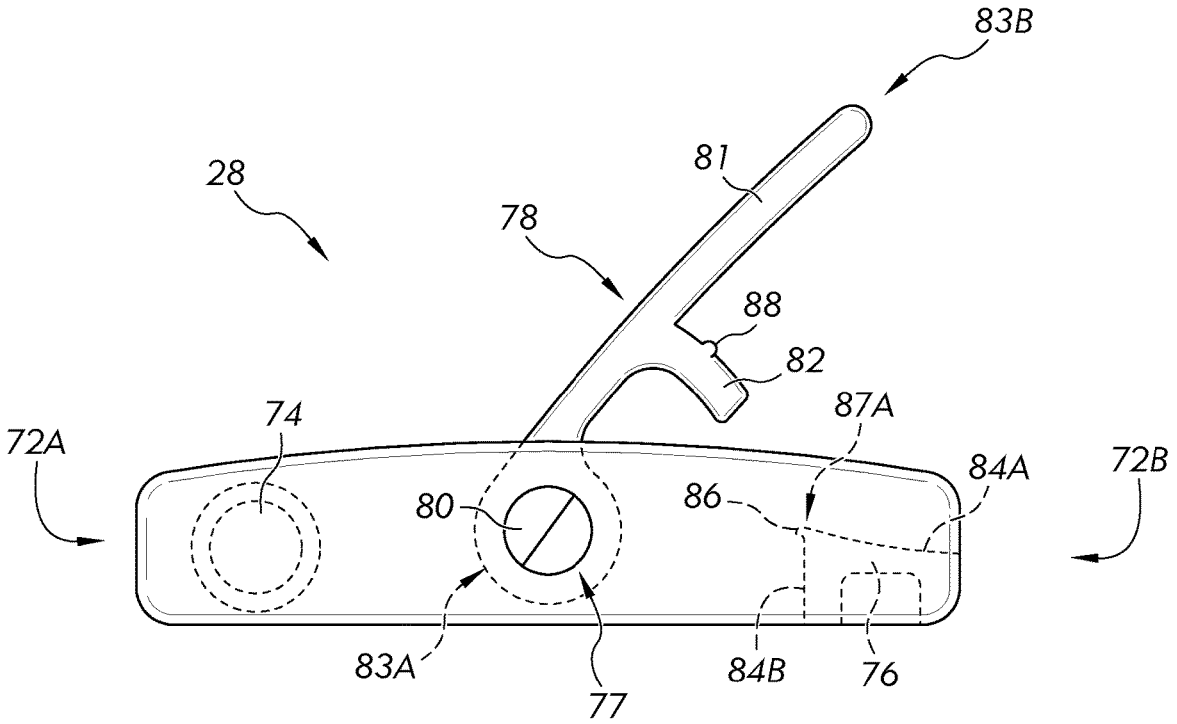
FIG. 4A illustrates a side view of a belt buckle of FIG. 1 in an open position.
Figure 4B:
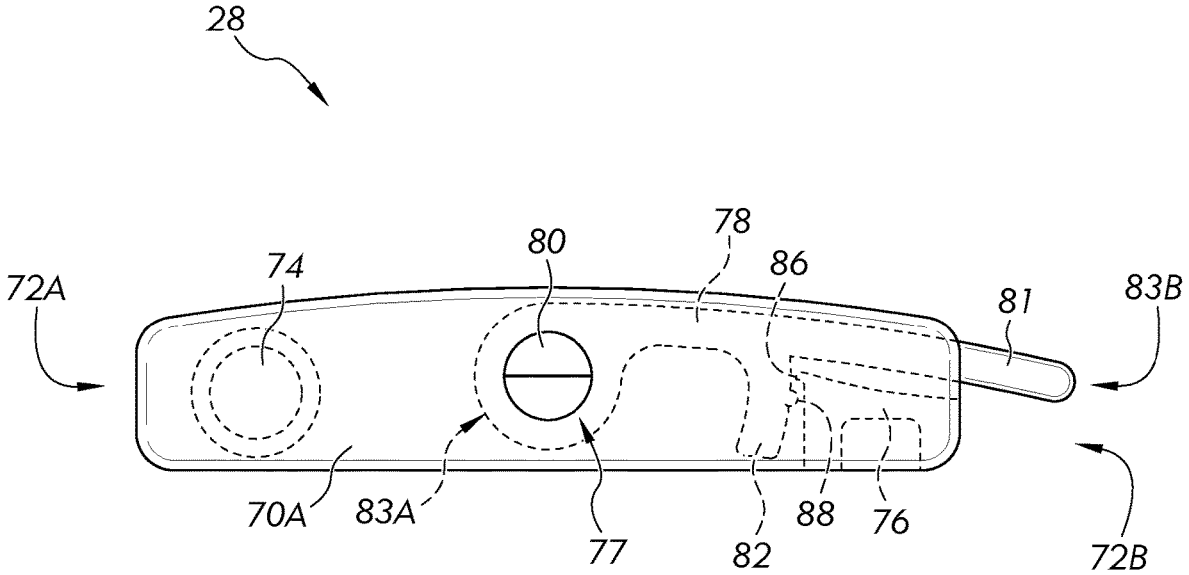
FIG. 4B illustrates a side view of the belt buckle of FIG. 1 in a closed position.

FIG. 4A illustrates a side view of the buckle 28 with the tongue 78 in an open position (which is more open than the open position of FIG. 3A), and FIG. 4B illustrates a side view of the buckle 28 with the tongue 78 in the closed position.

As shown in FIG. 4A, the tongue 78 includes opposing first and second ends 83A-B. The tongue 78 also includes a lever portion 81 and a tab 82 that extends outward from the lever portion 81. The lever portion 81 can be used for lifting the tongue 78 to the open position and pushing down on the tongue 78 to the closed position, for example. The lever portion 81 terminates at end 83B of the tongue 78, while the pivot axis A3 is provided proximate to end 83A of the tongue 78.

The second support member 76 includes a first surface 84A and a second surface 84B that is angled with respect to the first surface 84A. A first projection 86 extends outward from the second surface 84B of the second support member 76, and a second projection 88 extends outward from the tab 82. In the open position shown of FIG. 4A, the second projection 88 is on a first side of the first projection 86, and in the closed position of FIG. 4B the second projection 88 is on the opposite second side of the first projection 86. The first projection 86 and second projection 88 are offset from each other in each of the open and closed positions.

In the closed position of FIG. 4B, the first projection 86 extends outwards from the second surface 84B towards the tab 82. Also, in the closed position of FIG. 4B, the second projection 88 extends outward from the tab 82 towards the second surface 84B in a direction approximately parallel to that of the lever portion 81.

In one example, the first projection 86 extends along a full length of the second support member 76 tab between the opposing first and second sidewalls 70A-B, and the second projection 88 similarly extends from the first edge 79A of the tongue 78 to the second edge 79B of the tongue 78. In a further example, the first projection 86 and/or second projection 88 include a plurality of discreet portions are not continuous.

Referring to FIG. 4B, the sidewall 70A-B define a boundary. In the closed position the second projection 88 is within that boundary, and in the open position of FIG. 4A, the second projection 88 is outside that boundary.

Figure 5:
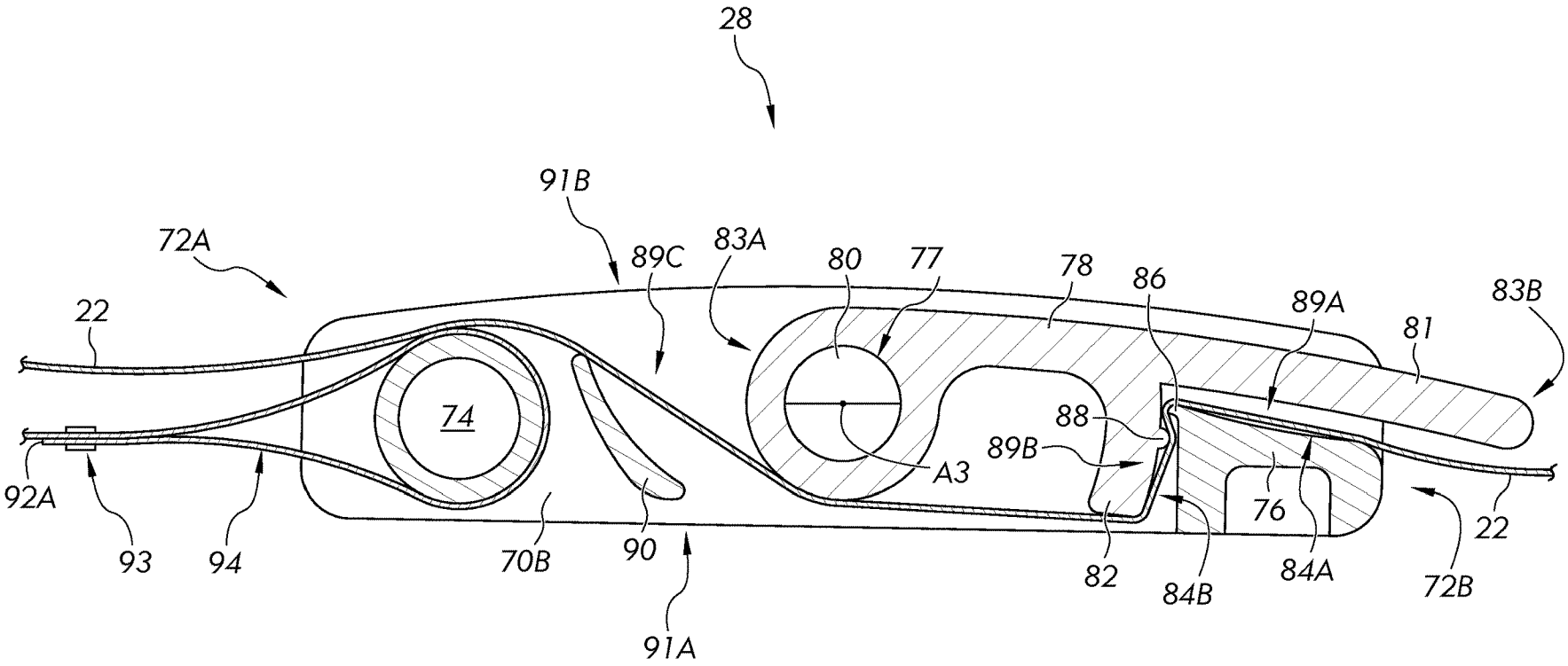
FIG. 5 illustrates an example belt path through the belt buckle of FIG. 1.

FIG. 5 illustrates a side view of the buckle 28 and an example belt path 89 that extends through the buckle 28 from the belt-accepting end 72B to the belt-attaching end 72A. The belt path 89 includes a first portion 89A, second portion 89B, and third portion 89C. The first portion 89A extends from the belt-accepting end 72B to the second portion 89B, and is provided between the lever portion 81 and the first surface 84A of the second support member 76. The second portion 89B is provided between the tab 82 and the second surface 84B of the second support member 76. The third portion 89C is provided between the pivot axis A3 and the first support member 74. In the example of FIG. 5, an optional belt-guiding member 90 is provided that is sloped upwards from an inner edge 91A of the sidewalls 70 towards an opposing outer edge 91B of the sidewalls 70. The belt-guiding member 90 guides the belt strap 22 towards the outer edge 91B and around the first support member 74. In the example of FIG. 5, the third portion 89C of the belt path 89 is provided between the belt-guiding member 90 and the pivot axis A3. However, it is understood that the belt-guiding member 90 is optional and could be omitted.

As shown in FIG. 5, the belt path 89 is sinuous, and includes a plurality of turns, including a first turn at the first projection 86, includes a second turn at the second projection 88, a third turn at the end 83A of the tongue 78, and a fourth turn at the first support member 74. Additional quantities of turns could be provided, however, such as by providing additional extensions from the tab 82 and/or second surface 84B of the second support member 76.

The belt strap 22 includes a first end 92A and an opposing second end 92B. End 92A is attached to the belt-attaching end 72A of the buckle 28. In particular, end 92A of the belt strap 22 wraps around the first support member 74 and is fastened to the belt strap 22 with a rivet 93 to form a loop 94 that wraps around the first support member 74. Use of the rivet 93 is a non-limiting example, and other fastening techniques could be used, such as an adhesive or stitching.

The opposing end 92B of the belt strap 22 (not shown in FIG. 5) is received into the belt path 89 when the tongue 78 is in the open position. Once the belt strap 22 extends through the belt path 89 and is adjusted to a desired size, the tongue 78 is adjusted to the closed position, which clamps the belt strap 22 at least in the portions 89A-B of the belt path 89 and maintains the desired belt size.

The buckle 28 improves upon prior art designs by providing for secure clamping, which minimizes undesired belt resizing during game play, and by providing for each intentional adjustments by users of all ages.

Figure 6A:
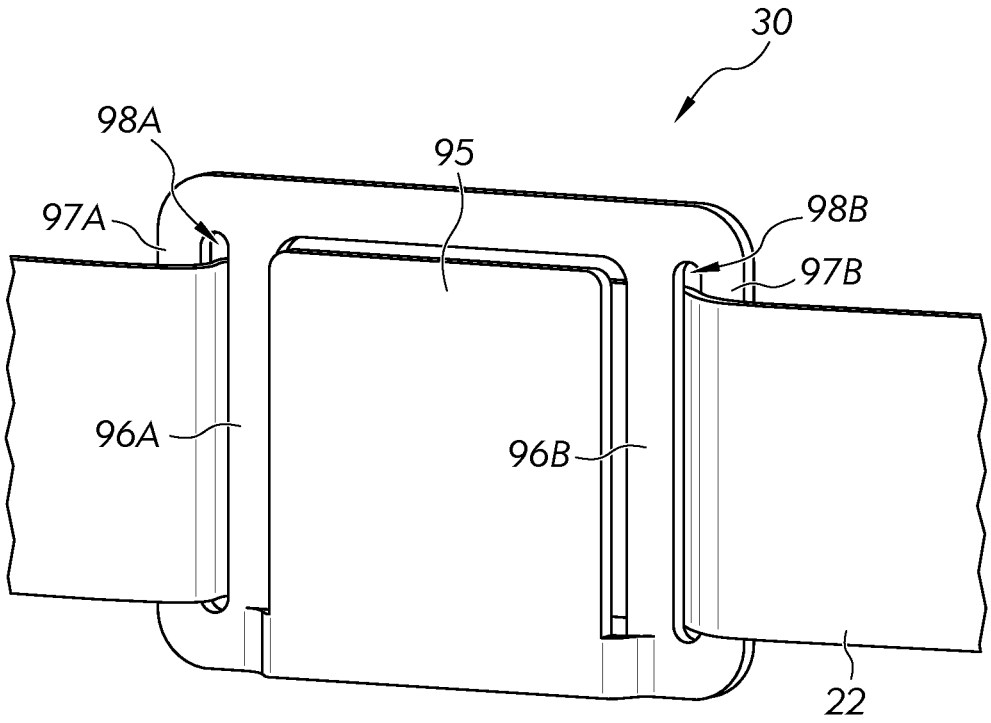
FIG. 6A illustrates a belt clip of FIG. 1 in greater detail.

FIG. 6A illustrates the belt clip 30 of FIG. 1 in greater detail, and shows how the belt strap 22 extends through the belt clip 30. The belt clip 30 includes a tongue 95 that is situated between two inner ribs 96A-B and two outer ribs 97A-B, which are disposed outward of the inner ribs 96A-B. A first belt path is provided behind the tongue 95 and behind the inner ribs 96A-B through openings 98A-B. Opening 98A is provide between inner rib 96A and outer rib 97A, and opening 98B is provided between inner rib 96B and outer rib 97B. A second belt path is provided behind the tongue 95 but in front of the ribs 96A-B.

Figure 6B:
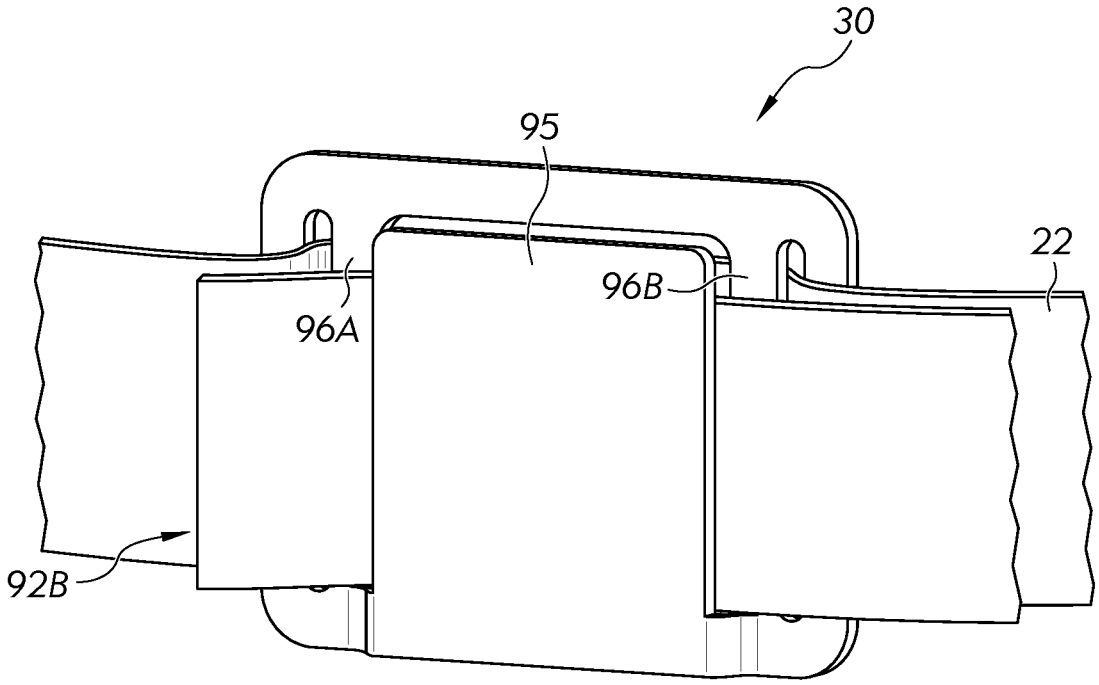
FIG. 6B illustrates the belt clip of FIG. 1 when a free end of a belt strap is received into the belt clip.

FIG. 6B illustrates the belt clip 30 with the free end 92B of the belt strap 22 received into the second belt path, which secures the free end 92B of the belt strap 22 against the belt strap 22. A wearer can slide the belt clip 30 to various discrete locations along the belt strap 22, to accommodate various length of slack at the free end 92B of the belt strap 22.

Although not shown in FIGS. 6A-B, logos 29B could be provided on the belt clip 30 as shown in FIG. 1.

Although example embodiments have been disclosed, a worker of ordinary skill in this art would recognize that certain modifications would come within the scope of this disclosure. For that reason, the following claims should be studied to determine the scope and content of this disclosure.

What is claimed is:

1. A belt buckle, comprising:

opposing first and second sidewalls that are fixed relative to each other and extend between a belt-attaching end and a belt-accepting end;

a support member extending between and fixed relative to the first and second sidewalls, and having a first surface and second surface that are angled with respect to each other, a first projection extending outwards from the second surface; and a tongue that pivots with respect to the first and second sidewalls between an open position and a closed position, the tongue including a lever portion and a tab that extends outwards from the lever portion, a second projection extending outwards from the tab;

wherein the belt buckle provides a sinuous belt path that in the closed position extends from the belt-accepting end to a first portion and then to a second portion, the first portion provided between the lever portion and the first surface, and the second portion provided between the tab and the second surface;

wherein in the open position, the second projection is on a first side of the first projection; and wherein in the closed position:

the second projection is on a second side of the first projection that is opposite the first side;

the first projection extends outwards from the second surface towards the tab;

the second projection extends outwards from the tab towards the second surface in a direction approximately parallel to the lever portion; and the belt path includes a first turn at the first projection and a second turn at the second projection.

2. The belt buckle of claim 1, wherein:

in the open position, the second projection is outside a boundary of the sidewalls; and in the closed position, the second projection is within the boundary of the sidewalls.

3. The belt buckle of claim 1, wherein a pivot opening is provided in the tongue or opposing sidewalls, and a pivot member extends into each pivot opening at a location between the belt-attaching end and the belt-accepting end, the tongue pivoting about a longitudinal axis of the pivot member, and in the closed position the second projection extends outwards from the tab in a direction away from each pivot opening.

4. The belt buckle of claim 3, comprising:

a belt-guiding member that extends between the first and second sidewalls at a location between the pivot member and the belt-attaching end, the belt-guiding member sloped upwards from an inner side of the belt buckle towards an outer side of the belt buckle, a third portion of the belt path provided between the belt-guiding member and the pivot member.

5. A flag football belt, comprising:

a belt strap;

a flag strap;

a magnetic clasp assembly that removably secures the flag strap to the belt strap; and a belt buckle comprising:

opposing first and second sidewalls that are fixed relative to each other and extend between a belt-attaching end and a belt-accepting end, the belt-attaching end attached to a first end of the belt strap, and the belt-accepting end configured to removably accept a second end of the belt strap;

a support member extending between and fixed relative to the first and second sidewalls and having a first surface and second surface that are angled with respect to each other, a first projection extending outwards from the second surface; and a tongue that pivots with respect to the first and second sidewalls between an open position and a closed position, the tongue including a lever portion and a tab that extends outwards from the lever portion, a second projection extending outwards from the tab;

wherein the belt buckle provides a sinuous belt path that in the closed position extends from the belt-accepting end to a first portion and then to a second portion and then through the belt-attaching end, the first portion provided between the lever portion and the first surface, and the second portion provided between the tab and the second surface;

wherein in the open position, the second projection is on a first side of the first projection; and wherein in the closed position:

the second projection is on a second side of the first projection that is opposite the first side;

the first projection extends outwards from the second surface towards the tab;

the second projection extends outwards from the tab towards the second surface in a direction approximately parallel to the lever portion; and the belt path includes a first turn at the first projection and a second turn at the second projection.

6. The flag football belt of claim 5, wherein in the open position the second projection is outside a boundary of the sidewalls, and in the closed position the second projection is within the boundary of the sidewalls.

7. The flag football belt of claim 5, wherein:

a pivot opening is provided in the tongue or the opposing sidewalls, and a pivot member extends into each pivot opening at a location between the belt-attaching end and the belt-accepting end, the tongue pivoting about a longitudinal axis of the pivot member, and in the closed position the second projection extends outwards from the tab in a direction away from the pivot opening; and the belt buckle includes a belt-guiding member that extends between the first and second sidewalls at a location between the pivot member and the belt-attaching end, the belt-guiding member sloped upwards from an inner side of the belt buckle towards an outer side of the belt buckle, a third portion of the belt path provided between the belt-guiding member and the pivot member.

8. The flag football belt of claim 5, wherein the magnetic clasp assembly includes:

a belt attachment member including first and second ends connected by a stem, a belt aperture at the first end that receives the belt strap, a first connector at the second end, and a first magnet; and a flag attachment member including a flag aperture at a first end that receives the flag strap, a second connector at the second end, and a second magnet;

wherein one of the first and second connectors includes a protrusion, and the other of the first and second connectors includes a receptacle sized to receive the protrusion; and wherein when the protrusion is received into the receptacle, one of the first and second magnets provides a magnetic force to the other of the first and second magnets that retains the protrusion in the receptacle.

* * * * *